US011713577B2

(12) United States Patent
Clarke et al.

(10) Patent No.: US 11,713,577 B2
(45) Date of Patent: Aug. 1, 2023

(54) REINFORCEMENT POSITIONER WITH CLIP

(71) Applicants: Jack Reese Clarke, Dayton, OH (US); Brandon Lee Cross, Centerville, OH (US)

(72) Inventors: Jack Reese Clarke, Dayton, OH (US); Brandon Lee Cross, Centerville, OH (US)

(73) Assignee: DAYTON SUPERIOR CORPORATION, Miamisburg, OH (US)

( * ) Notice: Subject to any disclaimer, the term of this patent is extended or adjusted under 35 U.S.C. 154(b) by 58 days.

(21) Appl. No.: 17/350,753

(22) Filed: Jun. 17, 2021

(65) Prior Publication Data

US 2022/0403656 A1 Dec. 22, 2022

(51) Int. Cl.
*E04C 5/20* (2006.01)
*E04C 5/04* (2006.01)

(52) U.S. Cl.
CPC ..... *E04C 5/201* (2013.01); *E04C 5/205* (2013.01); *E04C 5/04* (2013.01)

(58) Field of Classification Search
CPC ..... E04C 5/201; E04C 5/205; E04C 5/206; E04C 5/208; E04C 5/04; E04C 5/162; E04C 5/163; E04C 5/165; E04C 5/166; E04C 5/167; E04C 5/168; E04C 5/18; E04C 5/20; E04C 5/203
USPC ..... 52/677, 687
See application file for complete search history.

(56) References Cited

U.S. PATENT DOCUMENTS

| | | | | |
|---|---|---|---|---|
| 4,060,954 | A | 12/1977 | Liuzza | |
| 5,269,113 | A | 12/1993 | Dreizler | |
| 5,893,252 | A | 4/1999 | Hardy, Jr. et al. | |
| 6,092,960 | A | 7/2000 | McCallion | |
| 6,772,571 | B1 * | 8/2004 | Sorkin | E04C 5/20 52/684 |
| 6,948,291 | B2 | 9/2005 | Haslem et al. | |
| 7,108,453 | B2 * | 9/2006 | Harris | E04C 5/168 404/136 |
| D571,189 | S * | 6/2008 | Verelli | D8/354 |
| 7,908,809 | B2 * | 3/2011 | Meier | E04F 21/05 52/319 |
| 8,312,687 | B2 | 11/2012 | Yee | |

(Continued)

FOREIGN PATENT DOCUMENTS

| | | |
|---|---|---|
| EP | 0353560 A | 2/1990 |
| EP | 0606107 A1 | 7/1994 |

(Continued)

OTHER PUBLICATIONS

Technical Data Sheet for "Aztec® EZ Connect™ PSB," by Dayton Superior Corporation, 2 pages, Jul. 28, 2020.

(Continued)

*Primary Examiner* — William V Gilbert
(74) *Attorney, Agent, or Firm* — Thompson Hine LLP

(57) ABSTRACT

A system including a reinforcement positioner having a body with a longitudinally-extending spine and a plurality of legs coupled to the spine along a length thereof and at least partially extending away from the spine. The positioner further includes an opening or recess positioned in the body, and a clip configured to be received and retained in the opening or recess.

27 Claims, 7 Drawing Sheets

(56) References Cited

U.S. PATENT DOCUMENTS

| | | | | |
|---|---|---|---|---|
| 8,776,328 | B2 | 7/2014 | Kodi | |
| 10,604,933 | B1 * | 3/2020 | Gilner | E04C 5/20 |
| D891,231 | S * | 7/2020 | Gilner | D8/354 |
| 2004/0031228 | A1 * | 2/2004 | Hardy, Jr. | E04C 5/205<br>404/136 |
| 2010/0307098 | A1 * | 12/2010 | Yee | E04C 5/168<br>52/677 |
| 2014/0270949 | A1 * | 9/2014 | Heady | E01C 11/08<br>404/70 |
| 2020/0040581 | A1 | 2/2020 | Paulger | |

FOREIGN PATENT DOCUMENTS

| | | | | |
|---|---|---|---|---|
| WO | 2004/016855 | A2 | 2/2004 | |
| WO | WO-2018176088 | A1 * | 10/2018 | E04C 5/168 |

OTHER PUBLICATIONS

Product literature for "Aztech® EZ Connect PSB," by Dayton Superior Corporation, 2 pages, 2020.
Technical Data Sheet for "Bartender™ Plastic Foundation Wheels," by Dayton Superior Corporation, 2 pages, May 29, 2018.
Technical Data Sheet for "PSW-Aztech® Space Wheel™," by Dayton Superior Corporation, 1 page, Oct. 8, 2018.

* cited by examiner

REINFORCEMENT POSITIONER WITH CLIP

The present invention is directed to a positioner for a reinforcer for use in concrete construction, and more particularly, to a positioner with a clip.

BACKGROUND

Reinforcement positioners are commonly used in the construction industry to support rebar, post-tension cables, wire mesh or other reinforcements which can be made of metal, steel, fibers, glass, polymers or plastic (collectively termed a "reinforcing structure" or "reinforcing structures" herein) at a desired position during a concrete pour. However, many positioners are configured for use in horizontal configurations. Some positioners may be used in a vertical configuration but such positioners can require significant time and labor to configure and install.

SUMMARY

In one embodiment the present invention is directed to a system including a reinforcement positioner having a body with a longitudinally-extending spine and a plurality of legs coupled to the spine along a length thereof and at least partially extending away from the spine. The positioner further includes an opening or recess positioned in the body, and a clip configured to be received and retained in the opening or recess.

DETAILED DESCRIPTION

Figure 1:
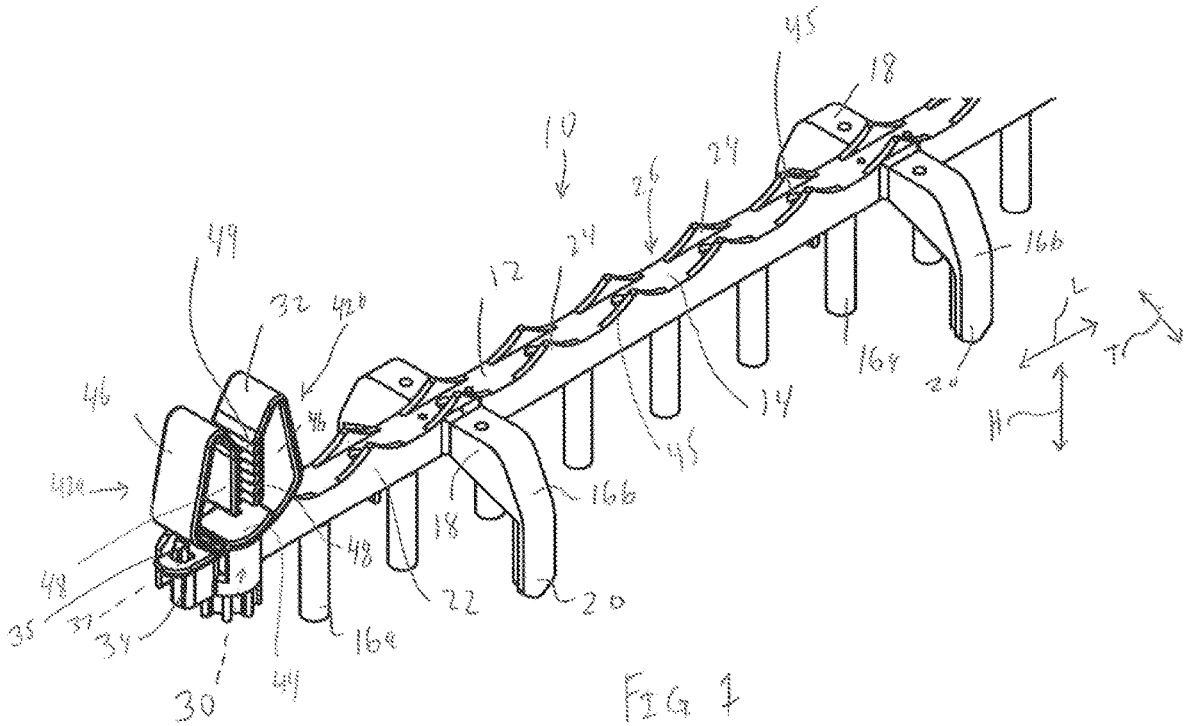
FIG. 1 is a side perspective detail view of part of one embodiment of the reinforcement positioner.

With reference to FIGS. 1-5, in one embodiment a reinforcement positioner or slab bolster, generally designated 10, has a body 12 including longitudinally extended spine 14 extending along a length direction L. A plurality of legs 16 are coupled to the spine 14 along the length thereof and extend away from the spine 14. The legs 16 can include a plurality of "stub" or straight legs 16*a* (also termed "first" legs herein) which are coupled to an underside of the spine 14 and are oriented perpendicular to the length direction L in a height direction H. Each stub leg 16*a* is generally cylindrical in the illustrated embodiment, but can take a variety of other shapes or forms. The reinforcement positioner 10 can also include a plurality of "span" legs 16*b* which are angled and/or curved and which may also be termed "second" legs herein. Each of the span legs 16*b* is, in the illustrated embodiment, coupled to a side of the spine 14, and has an upper portion 18 that is aligned in a thickness direction T before then extending, at its distal end 20, in the height direction H.

Figure 3:
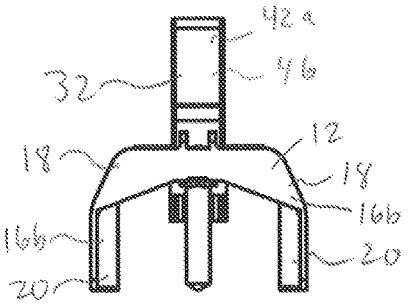
FIG. 3 is an end view of the reinforcement positioner of FIG. 1.
Figure 4:
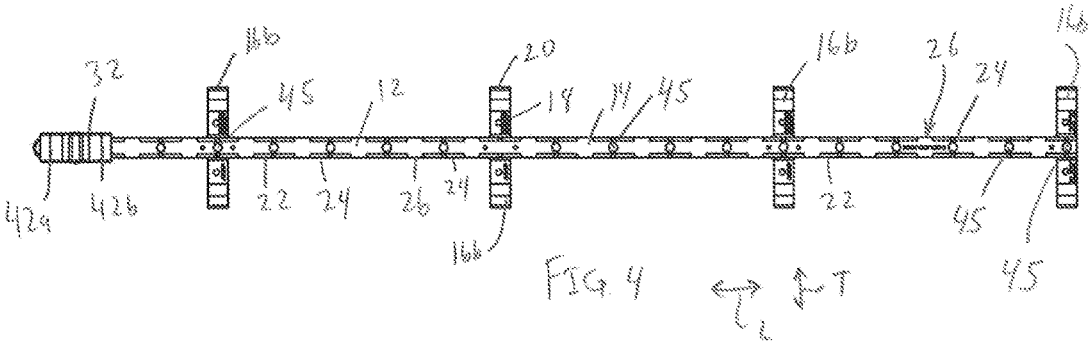
FIG. 4 is a top view of the reinforcement positioner of FIG. 1.
Figure 5:
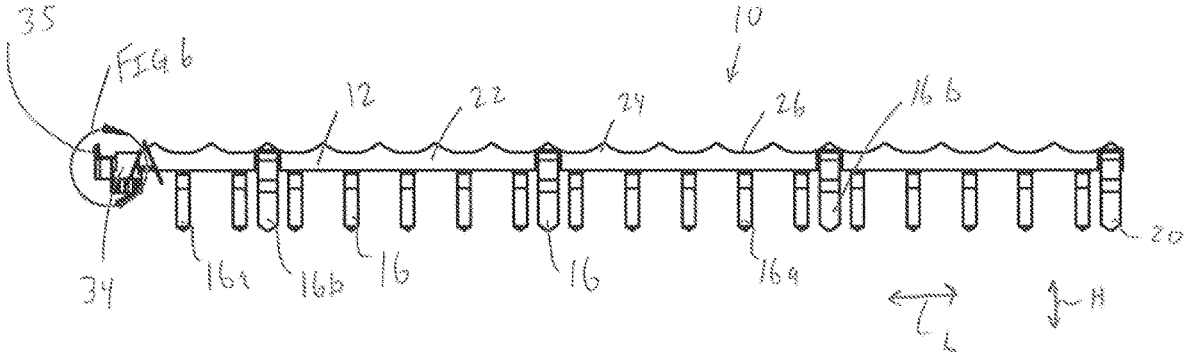
FIG. 5 is a side view of the reinforcement positioner of FIG. 1, shown without the clip.

In the illustrated embodiment, the span legs 16*b* are arranged in aligned pairs positioned on opposite sides of the spine 14, such that the reinforcement positioner 10 has a generally inverted "U" shape in end view as shown in FIG. 3. Each of the legs 16 (including the stub legs 16*a* and the span legs 16*b*) may extend same amount in the height direction H such that a distal end of each leg 16 is located the same distance from the spine 14 and aligned in a plane such that the reinforcement positioner 10 can be stably positioned on a flat planar surface. The span legs 16*b* can help to provide greater stability to the reinforcement positioner 10 when in use to prevent rocking and to ensure that the reinforcement positioner 10 remains in the desired orientation. However, the span legs 16*b*, if utilized, can take any of a wide variety of shapes and forms beyond those shown herein.

The reinforcement positioner 10 and/or body 12 can be made of any of a wide variety of materials including polymers, plastics, thermoplastics, fiberglass or other materials which may exhibit low water absorption, relatively high strength and relatively high impact resistance. The positioner 10 can have a variety of lengths, such as at least about eighteen inches in one case, or at least about two feet in another case, or less than about ten feet in another case. The positioner 10 can have a variety of number of legs 16, such as at least about five legs 16 in one case, or at least about ten legs 16 in another case.

The spine 14 can include or be coupled to a pair of side walls 22 on an upper surface thereof that have a curved/variable/undulating height having a wave-like appearance. Each side wall 22 thus includes, defines or is defined by a plurality of ridges 24 and which define a plurality of positioning recesses 26 between the adjacent ridges 24. The positioning recesses 26 are configured to receive a reinforcing structure 40 therein as will be described in greater detail below.

Figure 2:
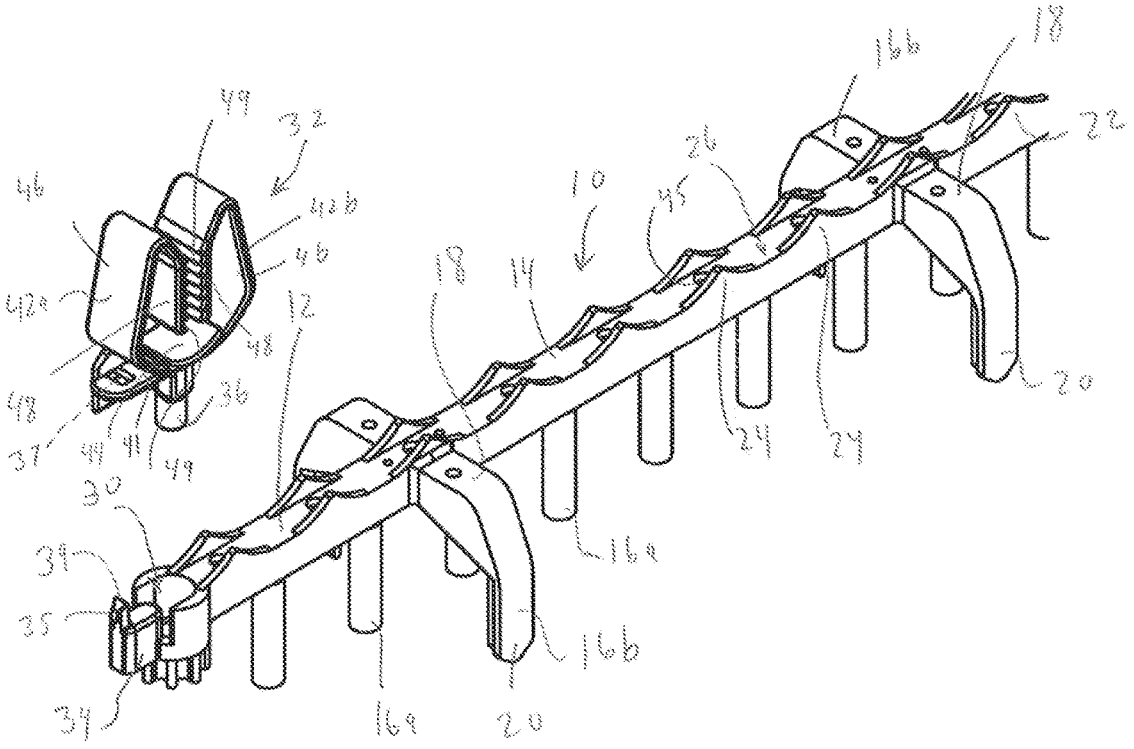
FIG. 2 is a side perspective view of the reinforcement positioner of FIG. 1, with the clip exploded away from a remainder of the positioner.
Figure 6:
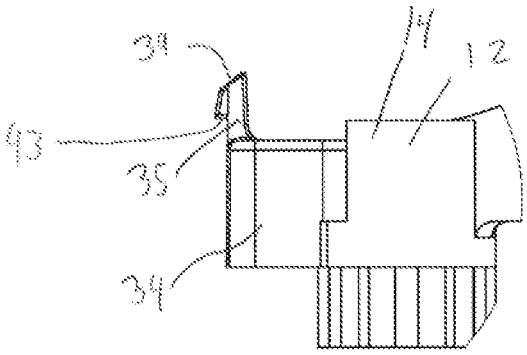
FIG. 6 is a detail view of the designated portion of FIG. 5.

With reference to FIG. 2, the body 12 (and more particularly the spine 14 in the illustrated embodiment) includes an opening or recess 30 which is shaped/size/configured to receive a clip 32 therein (and/or receive a leg 16*a* therein, as will be described in greater detail below). The reinforcement positioner 10 includes a pair of opposed ends with respect to its length and in the illustrated embodiment the opening or recess 30 is positioned at or adjacent to one of the opposed ends. The reinforcement positioner 10 can include a retaining tab 34 positioned adjacent to the opening/recess 30 which includes an upwardly-extending, barb-shaped, elastically flexible coupling protrusion 35. As shown in FIG. 6, the coupling protrusion 35 has an angled or ramp-shaped surface at its distal end.

Figure 7:
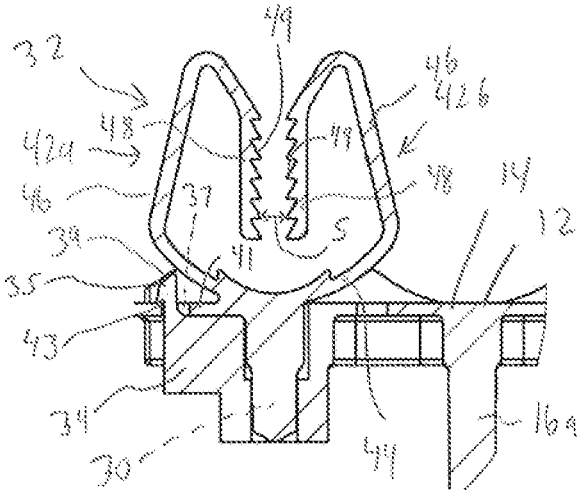
FIG. 7 is a detail cross sectional view of part of the positioner of FIG. 1.

The clip 32 includes a protrusion 36 on its bottom surface which is configured to be releasably and closely received in the opening/recess 30, and a flange 41 with a coupling opening 37 formed therethrough. When the protrusion 36 of the clip 32 is sufficiently inserted into the opening/recess 30, the ramp surface 39 of the coupling protrusion 35 engages the coupling opening 37 and the coupling protrusion 35 is urged in a radial direction relative to the opening/recess 30 (radially inwardly, to the right, in the embodiment of FIG. 7). When the clip 32 is inserted to a sufficient depth, the coupling protrusion 35 passes entirely through the coupling opening 37 and snaps back to its unbiased position wherein the coupling protrusion 35 (e.g. a flat 43 on the underside of the coupling protrusion 35) is at least partially positioned over the flange 41 to thereby retain the clip 32 in place and prevent or limit removal and/or rotation of the clip 32.

In this manner, the clip 32 is manually insertable into the opening/recess 30, and may, in certain cases, if desired be able to be manually removed by manually moving the tab 35 in a radially inner direction to release the flange 41/clip 32. However it should be understood that the clip 32 can be coupled to the body 12/spine 14 by any of a wide variety of materials or structures, including snap fits, interference fits, threaded attachments, brackets, clips, inter-engaging shapes, adhesives, etc. In addition, the position of the coupling protrusion 35 and coupling opening 37 can be reversed such that the coupling protrusion 35 is located on the clip 32 and the opening 37 is located on the body 12 of the reinforcement positioner 10.

The clip 32 is configured to receive and retain therein a reinforcing structure 40 and can take any of a wide variety of shapes or forms. In the illustrated embodiment, the clip 32 is generally "U" shaped in end view and has a pair of opposed sides 42*a*, 42*b* and a base portion 44 positioned between the sides 42*a*, 42*b*. In the illustrated embodiment, the base portion 44 and/or entirety of the clip 32 is generally aligned in the length direction L, and is fixed in place and not freely rotatable in the opening/recess 30. In the illustrated embodiment, each of the sides 42*a*, 42*b* includes an outer arm 46 and an inner arm 48 coupled to the outer arm 46 and arranged generally parallel and spaced away from the outer arm 46. One or both of the inner arms 48 are elastically deformable away from each other (in the outer direction), and include a set of gripping teeth 49 on an inner surface thereof.

Figure 8:
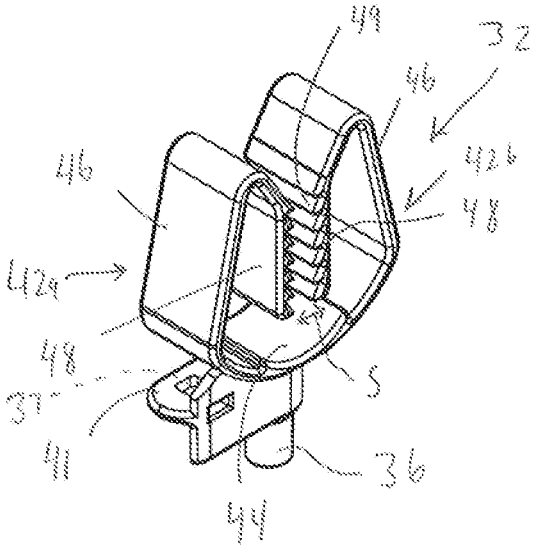
FIG. 8 is a perspective view of the clip of the reinforcement positioner of FIGS. 1-4.
Figure 15:
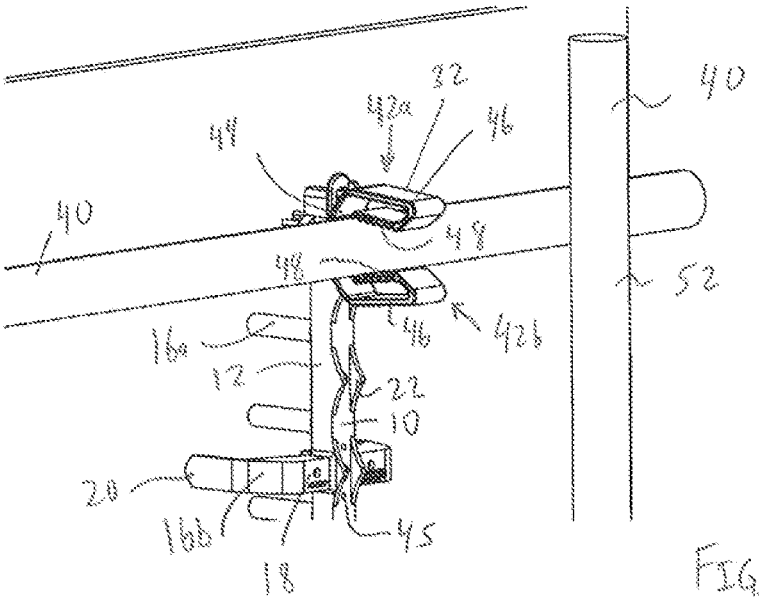
FIG. 15 is a detail view of the designated portion of FIG. 14.

In one case, the inner surface of the sides 42*a*, 42*b* (e.g. the inner surfaces of the inner arms 48) can have a spacing S therebetween (see FIGS. 7 and 8) extending in the length direction L in one case, that is less than a thickness/diameter of the reinforcing structure 40 to be received therein. In this manner, when the reinforcing structure 40 is received in the clip 32 (see FIG. 15) the inner arms 48 are elastically deformed away from each other, and the gripping teeth 49 grip the reinforcing structure 40 to retain the reinforcing structure 40 in the clip 32. Thus, the reinforcing structure can in this case be a longitudinal reinforcing structure 40 which is retained in the clip 32/reinforcement positioner 10 in a configuration where the longitudinal reinforcing structure 40 is oriented generally perpendicular to the spine 14 and/or length direction L, aligned in the thickness direction T. In addition, when the reinforcing structure 40 is inserted into the clip 32, the reinforcing structure 40 can be inserted in the height direction H, oriented perpendicular to the spine 14 and/or length direction L.

Although the clips 32, in the illustrated embodiment, utilizes deformable sides 42*a*/42*b* and/or deformable arms 48 to grip the reinforcing structure 40, it should be understood that the clips 32 can take any of a wide variety of shapes and forms. For example, the clips 32 can grip or secure the reinforcing structure 40 by any of a wide variety of gripping structures including clips, snaps, brackets, fold-over retaining devices, separable retaining covers, rotatable or slidable retaining covers, etc.

Figure 9:
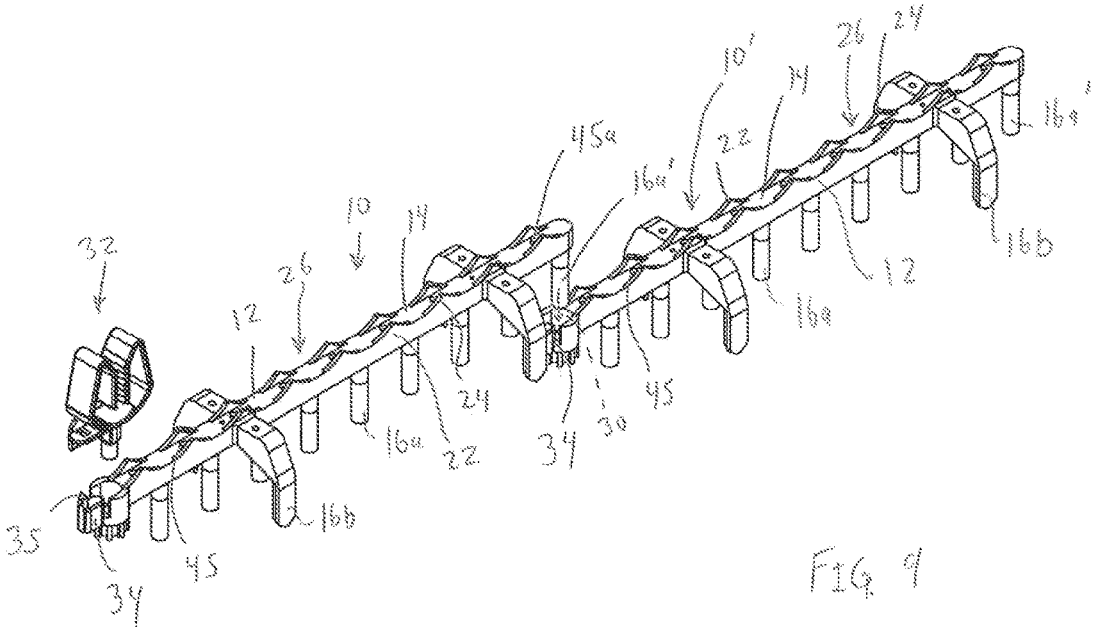
FIG. 9 is a perspective view showing the reinforcement positioner of FIG. 1 being coupled to another reinforcement positioner.
Figure 10:
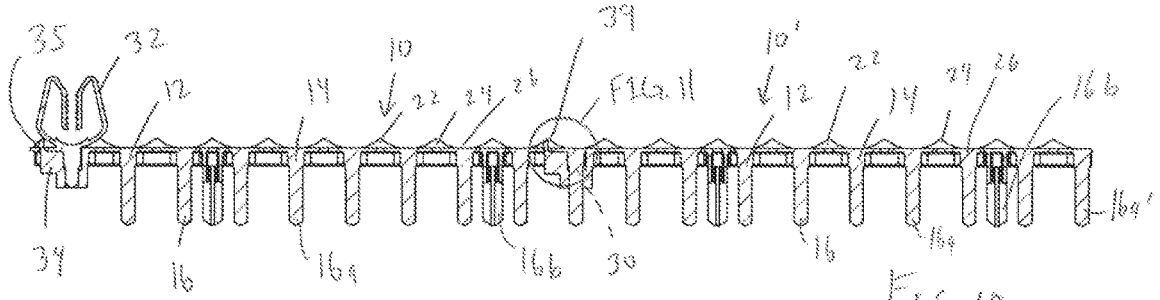
FIG. 10 is a side cross sectional view of the positioners of FIG. 9, after being coupled together.

With reference to FIGS. 9 and 10, a reinforcement positioner 10 can be used in conjunction with another reinforcement positioner 10'. Each reinforcement positioner 10, 10' can include a distal leg 16*a'* located at an opposite end of the reinforcement positioner 10, 10' relative to the opening/recess 30 or clip 32. The distal leg 16*a'* can have a size and/or shape the same as or similar to the protrusion 36 of the clip 32 such that the distal leg 16*a'* is closely and removably receivable in the opening/recess 30' of any of the other reinforcement positioners 10, 10'. In addition, each reinforcement positioner 10 can includes a series of coupling openings 45 formed in the body 12/spine 14 and extending along its length. At least one of the coupling openings 45 may be located adjacent to the distal leg 16*a'*.

Figure 11:
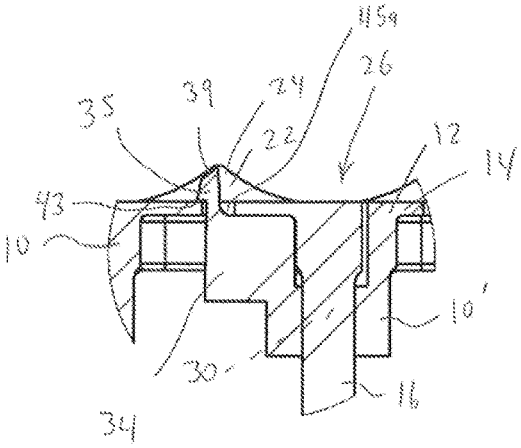
FIG. 11 is a detail view of the designated portion of FIG. 10.

In this manner, the reinforcement positioner 10 can be coupled to the other reinforcement positioner 10' simply by inserting the distal leg 16*a'* into the opening/recess 30 of the other reinforcement positioner 10', as shown by the arrow in FIG. 9. The coupling protrusion 35 of the other reinforcement positioner 10' can protrude through the coupling opening 45*a* of the positioner 10 to thereby couple the positioners 10, 10' together, as shown in FIG. 11. Similarly, the other reinforcement positioner 10' can be coupled to yet another reinforcement positioner (not shown) by inserting its distal leg 16*a'* into the opening/recess 30 of the yet another reinforcement positioner. In this manner, a number of reinforcement positioners 10 can be coupled together as desired to form a line/column of reinforcement positioners 10 having the desired length. Thus as can be seen the positioners 10 can be coupled together using the same structure which is utilize to couple a clip 32 to the positioners 10.

Figure 12:
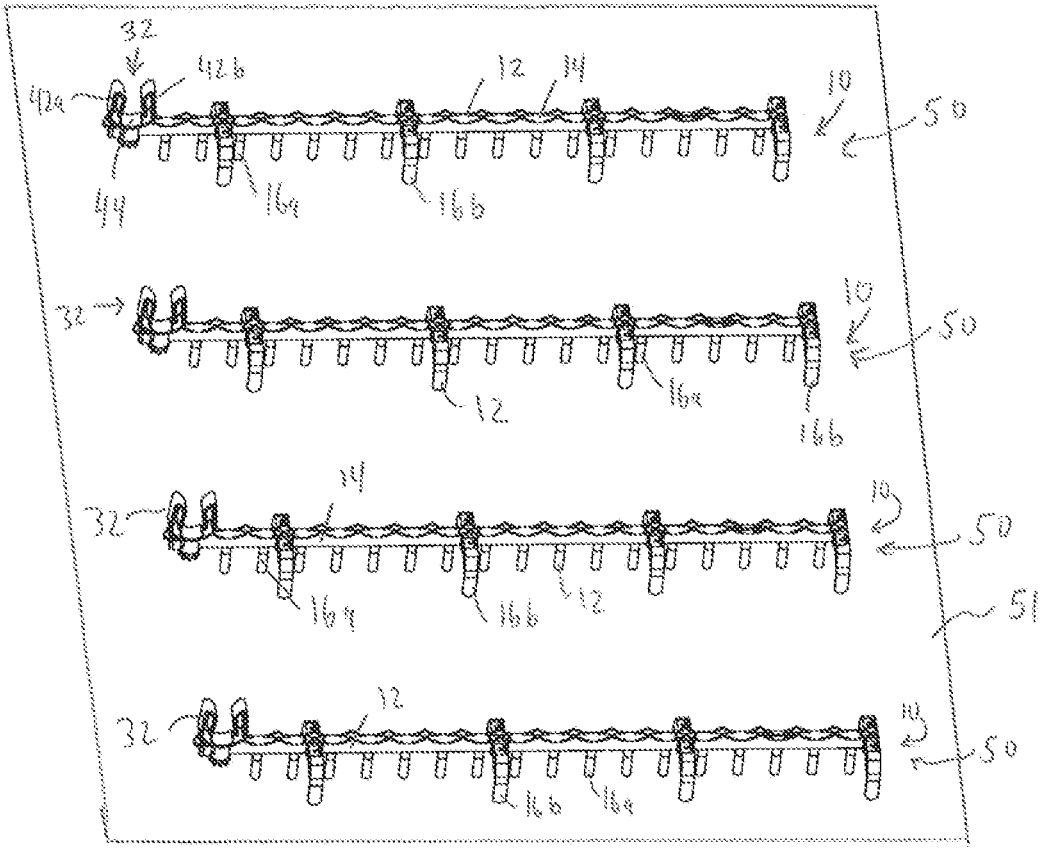
FIG. 12 is an upper perspective view of a plurality of reinforcement positioners arranged in parallel configurations.
Figure 13:
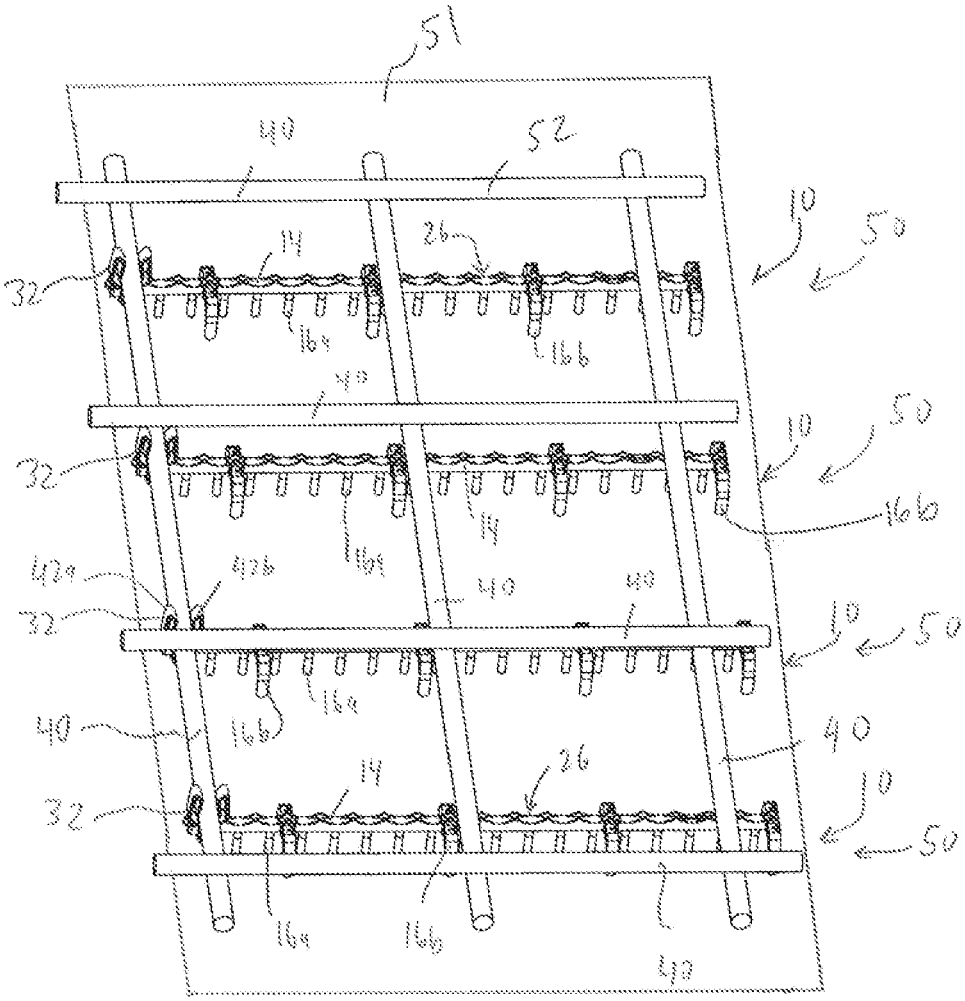
FIG. 13 is an upper perspective view of the reinforcement positioners of FIG. 12, with a matrix of reinforcing structures coupled thereto.

In order to utilize the reinforcement positioner 10, a series of reinforcement positioners 10 can be arranged in parallel spaced-apart columns 50 as shown in FIG. 12. If desired, the reinforcement positioners 10 can be coupled to additional reinforcement positioners 10 to provide a desired length of the columns 50 as described above in the context of FIGS. 9-11. If desired, only a single one of the reinforcement positioners 10 in a column 50 may include a clip 32, and each clip 32 can be aligned with at least one other clip 32 of another positioner 10/column 50. In the embodiment of FIGS. 12 and 13, for ease of assembly, the columns 50 of reinforcement positioners 10 may be positioned on a horizontal surface 51, such as a floor, panel ground surface or the like.

Next, as shown in FIG. 13, reinforcing structures 40 or reinforcing structure assembly 52 can be coupled to the columns 50 of reinforcement positioners 10 of FIG. 12. In the embodiment of FIG. 13, the reinforcing structure assembly 52 takes the form of a plurality of reinforcing structures 40 in the form of generally longitudinally-extending cylindrical components, such as rebar, coupled together in perpendicular/parallel configurations to form a mat or matrix of reinforcing structures 40. If desired, the various reinforcing structures 40 can be coupled together, at their various points of intersection, by wire ties or the like (not shown). Each reinforcing structure 40 or portions thereof positioned on or adjacent to a reinforcement positioner 10 (other than at the clip 32) can be received in one of the positioning recesses 26 along the spine 14 of the associated reinforcement positioner.

Figure 14:
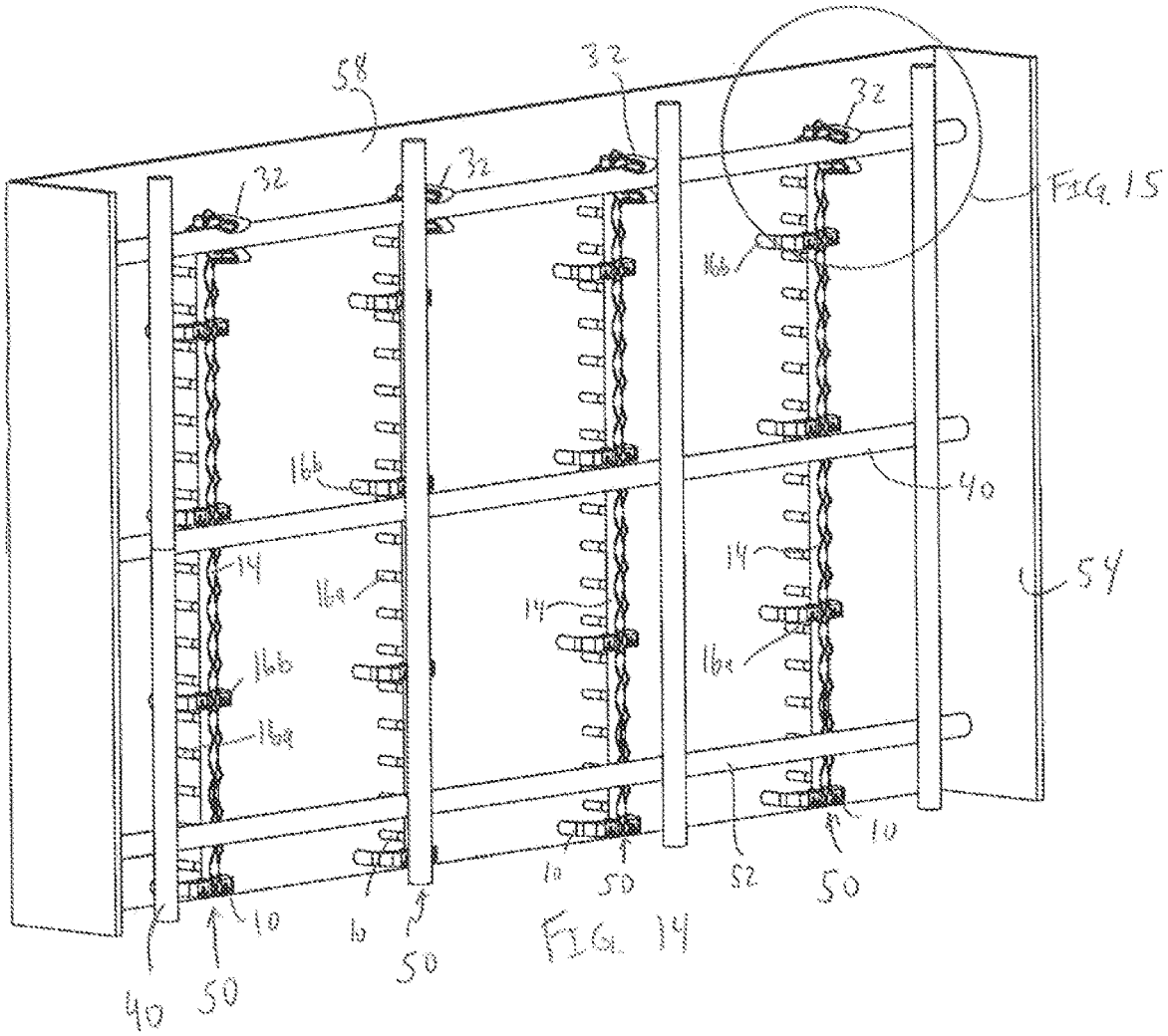
FIG. 14 is a front perspective view of the reinforcement positioners/reinforcing structures of FIG. 13, arranged in a vertical position and positioned within a form.

Next, as shown in FIG. 14, the entire assembly of FIG. 13 can be moved or tilted up into a vertical configuration with respect to for example, a gravitational frame of reference and placed in a form 54 (a three sided form 54 is shown in FIG. 14 for illustrative purposes). The bottom ends of the reinforcement positioners 10/reinforcing structures 40 can rest on a ground surface, floor surface or the like. The columns 50 of reinforcement positioners 10 can be configured to have a height generally matching, or perhaps slightly shorter (e.g. within 10% in one case) than the form 54 by selecting appropriately-size positioners and/or cutting the positioners to size.

The reinforcing structure assembly 52 is suspended from the clips 32 that extend along the upper edge of the columns 50, and the reinforcing structure assembly 52 generally hangs down from the clips 32. Accordingly, in one embodiment each reinforcement positioner 10 and/or each column 50 includes, at most, a single clip 32 of the illustrated form and/or a clip 32 which can be coupled to and/or receive a reinforcing structure 40. When positioned as shown in FIG. 14, the reinforcement positioners 10 position the reinforcing structures 40 at the desired depth (e.g. in the height direction H) within the form 54. If desired, a stack of multiple assemblies of reinforcement positioners 10/reinforcing structures 40 can be positioned in the same form 54 (e.g. in the height direction H of the reinforcement positioner). Next, the form 54 can be sealed/closed (e.g. a front panel (not shown) oriented parallel to and opposite from the back panel 58 is secured to of forms part of the form 54).

Concrete in its liquid/uncured form can then be poured in the form 54, and the reinforcement positioners 10 and reinforcing structures 40 remain in place and are immersed, remaining in the finished poured concrete structure when cured such that the reinforcing structures 40/reinforcing structure assembly 52 add strength and durability to the finished reinforced concrete product. After pouring and curing, the poured structure can remain in place in the vertical position or, if desired, can be released from its form 54 and lowered to a horizontal or other configuration for use as desired. The reinforcement positioner 10 can thus be used for pouring or forming vertically oriented components in place, such as walls, columns, or other components where their greatest dimension (e.g. height, thickness or lengths) is oriented vertically.

In the embodiment of FIG. 14, the upper horizontally-extending portion of the reinforcing structure assembly 52 is the only component or part thereof that is directly coupled to the reinforcement positioners 10. Thus, this arrangement provides the ability to quickly and easily, yet securely, couple the reinforcing structures 40/reinforcing structure assembly 52 to the positioner 10. In addition, the clips 32 and reinforcement positioners 10 provide a modular assembly which is quick and easy to assemble. In particular, the reinforcement positioners 10 can be shipped on-site in the configuration shown in FIG. 2, in which the clip 32 is not coupled to any reinforcement positioner 10. A reinforcement positioner 10 can then be selected and the clip 32 inserted into the opening/recess 30 of that reinforcement positioner, to convert that "generic" reinforcement positioner (as shown in FIG. 2) to a "specialized" reinforcement positioner (as shown in FIG. 1) which is configured to be coupled to a reinforcing structure 40 or reinforcing structure assembly 52. Various reinforcement positioners 10 can be quickly and easily coupled together to provide the desired length of column 50. In addition, attachment of the clip 32 and/or other positioners 10 utilize the same opening/recess 30 and the same coupling protrusion 35 of the reinforcement positioner 10 to enable the reinforcement positioners 10 and clips 32 to be used in a modular manner. Finally, a single reinforcement positioner 10 or column 50 can extend for some length, and thereby position a number of reinforcing structures 40 as desired, instead of having to couple a plurality of reinforcement positioners along the length of a reinforcing structure.

Having described the invention in detail and by reference to the various embodiments, it should be understood that modifications and variations thereof are possible without departing from the scope of the claims of the present application.

What is claimed is:

1. A method comprising:

accessing a reinforcement positioner including a body having a longitudinally-extending spine, a plurality of legs coupled to the spine along a length thereof and at least partially extending away from the spine, an opening or recess positioned in the body, and a clip received in the opening or recess, wherein the clip is generally "U" shaped in end view having a pair of opposed sides and a base portion positioned between the sides, wherein an open end of the "U" faces away from the spine, and wherein the opening or recess is sized and shaped to receive a leg of another reinforcement positioner therein to thereby enable the reinforcement positioner to be coupled to the another reinforcement positioner;

securing a longitudinal reinforcing structure to the clip; and positioning the reinforcement positioner such that the spine is oriented generally vertically.

2. The method of claim 1 wherein the clip is retained in the opening or recess, wherein the reinforcing structure is oriented generally perpendicular to the spine, and wherein the method further includes the steps of positioning the reinforcement positioner and the reinforcing structure in a form, and filling the form with concrete such that the reinforcement positioner and the reinforcing structure are immersed in the concrete.

3. A system including a reinforcement positioner comprising:

a body including a longitudinally-extending spine and a plurality of legs coupled to the spine along a length thereof and at least partially extending away from the spine;

an opening or recess positioned in the body at or adjacent to an end of the longitudinally-extending spine; and a clip configured to be received and retained in the opening or recess, wherein the clip is generally "U" shaped in end view having a pair of opposed sides and a base portion positioned between the sides and configured that, when received and retained in the opening or recess, an open end of the "U" faces away from the spine.

4. The system of claim 3 wherein one of the body or the clip includes a coupling protrusion and the other one of the body or the clip includes a coupling opening that is configured receive the coupling protrusion therethrough to thereby couple the clip to the body when the clip is received in the opening or recess.

5. The system of claim 3 wherein the clip is configured to receive and retain therein a longitudinal reinforcing structure in an orientation where the reinforcing structure is oriented generally perpendicular to the spine.

6. The system of claim 3 further comprising a longitudinal reinforcing structure that is receivable in the clip, wherein inner surfaces of the sides have a spacing therebetween, when the reinforcing structure is not received in the clip, that is less than a thickness of the reinforcing structure.

7. The system of claim 3 wherein at least part of at least one side of the clip is elastically deformable away from the other side to enable a reinforcing structure to be positioned between the sides and thereby be retained in the clip.

8. The system of claim 3 wherein the base portion is oriented generally parallel to the spine.

9. The system of claim 3 wherein the clip is configured to receive a longitudinal reinforcing structure therein, wherein the reinforcing structure is insertable into the clip in an insertion direction that is oriented perpendicular to the spine and parallel to a height direction of the positioner.

10. The system of claim 3 wherein each leg extends at least partially away from the spine and has a distal end located opposite the spine, wherein a distal end of each of the legs is located a same distance from the spine as the other distal ends in a height direction oriented perpendicular to the spine.

11. The system of claim 3 wherein the clip is manually insertable into the opening or recess, and once sufficiently inserted resists removal from the opening or recess.

12. The system of claim 3 further comprising an additional positioner, the additional positioner including:

a body including a longitudinally-extending spine and a plurality of legs coupled to the spine along a length thereof and extending at least partially away from the associated spine; and an opening or recess positioned in the body;

wherein a leg of the positioner is received and retained in the opening or recess of the additional positioner to couple the positioner to the additional positioner to thereby form a column of positioners.

13. The system of claim 12 further comprising another column of positioners oriented parallel to and spaced away from the column of positioners, and wherein the system further includes a matrix of reinforcing structures, and wherein the matrix of reinforcing structures is coupled to the column of positioners and the another column of positioners.

14. The system of claim 12 wherein the body of the positioner includes a coupling protrusion that is received through a coupling opening of the additional positioner to thereby couple the positioner to the additional positioner.

15. The system of claim 3 wherein the clip is received and retained in the opening or recess, wherein the system further includes a longitudinal reinforcing structure that is received and retained in the clip, and wherein the spine is oriented generally vertically.

16. The system of claim 3 wherein the plurality of legs includes end legs at either end, and wherein the opening or recess is positioned between an end leg and an associated end of the body.

17. The system of claim 3 wherein at least one of the clip, or the opening or recess, is configured such that the clip is non-rotatably retained in the opening or recess.

18. A system including a reinforcement positioner comprising:

a body including a longitudinally-extending spine and a plurality of legs coupled to the spine along a length thereof and at least partially extending away from the spine;

an opening or recess positioned in the body; and a clip configured to be received and retained in the opening or recess, wherein the opening or recess is sized and shaped to receive a leg of another reinforcement positioner therein to thereby couple the reinforcement positioner to the another reinforcement positioner.

19. The system of claim 18 further comprising the another reinforcement positioner including a longitudinally-extending spine and a plurality of legs coupled to the spine along a length thereof and extending at least partially away from the spine, wherein one of the legs of the another reinforcement positioner is configured to be received and retained in the opening or recess of the reinforcement positioner.

20. A system including a reinforcement positioner comprising:

a body including a longitudinally-extending spine and a plurality of legs coupled to the spine along a length thereof and at least partially extending away from the spine;

an opening or recess positioned in the body; and a clip configured to be received and retained in the opening or recess, wherein the clip is generally "U" shaped in end view having a pair of opposed sides and a base portion positioned between the sides and configured that, when received and retained in the opening or recess, an open end of the "U" faces away from the spine, wherein the body includes a coupling protrusion that is configured be received through a coupling opening of another reinforcement positioner to thereby couple the reinforcement positioner to the another reinforcement positioner.

21. A system including a reinforcement positioner comprising:

a body including a longitudinally-extending spine and a plurality of legs coupled to the spine along a length thereof and at least partially extending away from the spine;

an opening or recess positioned in the body; and a clip configured to be received and retained in the opening or recess, wherein the positioner includes a distal leg located at an opposite end of the positioner relative to the opening or recess, and wherein the opening or recess is sized and shaped to closely receive the distal leg therein.

22. The system of claim 21 wherein the opening or recess is a single continuous opening or recess.

23. A system including a reinforcement positioner comprising:

a body including a longitudinally-extending spine and a plurality of legs coupled to the spine along a length thereof and extending at least partially away from the spine, wherein the body includes an opening or recess therein that is sized and shaped to receive a leg of another reinforcement positioner therein to thereby couple the reinforcement positioner to the another reinforcement positioner; and a clip configured to be received in the opening or recess to thereby be coupled to the body, wherein the clip is configured to receive and retain therein a longitudinal reinforcing structure inserted into the clip in a direction parallel to a height direction of the positioner.

24. The system of claim 23 wherein the clip is received in the opening or recess, and wherein the clip is configured to receive and retain the reinforcing structure in an orientation generally perpendicular to the spine.

25. The system of claim 23 wherein the opening or recess is a single continuous opening or recess.

26. A system including a reinforcement positioner comprising:

a body including a longitudinally-extending spine and a plurality of legs coupled to the spine along a length thereof and extending at least partially away from the spine, wherein the positioner includes an opening or recess positioned in the body; and a clip coupled to the body and configured to receive a reinforcing structure therein, wherein the spine is oriented vertically, wherein the clip is lockingly receivable in the opening or recess, and wherein the opening or recess is sized and shaped to receive a leg of another reinforcement positioner therein to thereby enable the reinforcement positioner to be coupled to the another reinforcement positioner.

27. The system of claim 26 wherein the opening or recess is a single continuous opening or recess.

* * * * *